US008677665B1

(12) United States Patent
Huber

(10) Patent No.: US 8,677,665 B1
(45) Date of Patent: Mar. 25, 2014

(54) TRIGGER ASSEMBLY

(76) Inventor: John F. Huber, Fond du Lac, WI (US)

( * ) Notice: Subject to any disclaimer, the term of this patent is extended or adjusted under 35 U.S.C. 154(b) by 80 days.

(21) Appl. No.: 13/362,201

(22) Filed: Jan. 31, 2012

Related U.S. Application Data

(63) Continuation-in-part of application No. 12/245,479, filed on Oct. 3, 2008, now Pat. No. 8,132,349.

(60) Provisional application No. 60/998,009, filed on Oct. 5, 2007.

(51) Int. Cl.
*F41A 19/00* (2006.01)

(52) U.S. Cl.
USPC ..... 42/70.04; 42/69.02; 42/69.01

(58) Field of Classification Search
USPC ..... 42/70.01, 69.01–69.03, 70.04–70.06, 42/DIG. 1; 89/136, 27.12, 27.11, 148; 124/31
See application file for complete search history.

(56) References Cited

U.S. PATENT DOCUMENTS

| | | | | |
|---|---|---|---|---|
| 727,458 | A | | 5/1903 | Roth |
| 817,198 | A | | 4/1906 | Smith |
| 949,467 | A | * | 2/1910 | Frommer ..... 89/148 |
| 2,126,076 | A | | 8/1938 | Wright et al. |
| 2,249,231 | A | | 7/1941 | Smith |
| 2,249,232 | A | | 7/1941 | Smith |
| 2,509,540 | A | | 5/1950 | Sunderland |
| 2,514,981 | A | * | 7/1950 | Walker et al. ..... 42/70.01 |
| 2,775,836 | A | | 1/1957 | Emerson |
| 2,856,717 | A | | 10/1958 | Parke |
| 3,183,616 | A | | 5/1965 | Gandy |
| 3,707,796 | A | | 1/1973 | Bielfeldt |
| 3,710,493 | A | * | 1/1973 | Gramiger et al. ..... 42/23 |
| 3,755,951 | A | | 9/1973 | Koon, Jr. |
| 3,950,876 | A | | 4/1976 | Wild et al. |
| 3,999,461 | A | * | 12/1976 | Johnson et al. ..... 89/191.01 |
| 4,005,540 | A | | 2/1977 | Robinson |
| 4,662,098 | A | | 5/1987 | Timari |
| 4,671,005 | A | | 6/1987 | Jewell |
| 4,719,841 | A | * | 1/1988 | Perrine ..... 89/189 |
| 4,730,406 | A | | 3/1988 | Forbes et al. |
| 4,926,574 | A | | 5/1990 | Rieger |
| 5,088,222 | A | * | 2/1992 | Larson ..... 42/70.04 |
| 5,109,622 | A | | 5/1992 | Echeberria |
| 5,487,233 | A | | 1/1996 | Jewell |

(Continued)

OTHER PUBLICATIONS

Remington 700 Trigger. A diagram marked "Attachment A" has been prepared by the Applicant, which is believed to be a fair representation of the Remington 700 trigger. Attachment A has not been published.

*Primary Examiner* — Jonathan C Weber
(74) *Attorney, Agent, or Firm* — Brannen Law Office, LLC

(57) ABSTRACT

A trigger may be pivotally connected to a frame at or near the top of the trigger. A sear transfer bar may be further provided and is pivotally connected to the frame. The pivot in the trigger is higher within the frame as compared to the pivot of the sear transfer bar. Two balls can be between the trigger and the sear transfer bar. The top of the sear transfer bar has a sear contact. Pulling the trigger in a first direction causes the trigger to rotate in a first direction. The sear transfer bar rotates under force of the trigger. The sear transfer bar and the trigger may rotate in opposite directions. The sear will drop when the sear contact of the transfer bar ceases engagement with the sear, causing the firearm to fire. The trigger assembly has a control arm extending beyond the trigger assembly frame.

5 Claims, 11 Drawing Sheets

(56) References Cited

U.S. PATENT DOCUMENTS

| | | | | |
|---|---|---|---|---|
| 5,784,818 | A | 7/1998 | Otteson | |
| 5,852,891 | A | 12/1998 | Onishi et al. | |
| 6,681,511 | B1 | 1/2004 | Huber | |
| 6,874,492 | B1 | 4/2005 | Schavone | |
| 6,978,568 | B2 | 12/2005 | Jewell | |
| 7,051,467 | B1 | 5/2006 | Huber | |
| 7,243,452 | B2 | 7/2007 | Zeh | |
| 7,430,827 | B1 | 10/2008 | Huber | |
| 8,117,779 | B2 * | 2/2012 | Doll et al. | 42/69.01 |
| 2005/0188580 | A1 | 9/2005 | Jewell | |
| 2009/0107024 | A1 * | 4/2009 | Doll et al. | 42/70.01 |
| 2010/0175291 | A1 | 7/2010 | Farley, Jr. et al. | |
| 2010/0269391 | A1 * | 10/2010 | Doll et al. | 42/70.05 |
| 2011/0030261 | A1 | 2/2011 | Karagias | |

* cited by examiner

TRIGGER ASSEMBLY

This application is a continuation-in-part application of pending United States patent application filed on Oct. 3, 2008 and having application Ser. No. 12/245,479, which itself is a non-provisional application that claims priority on and the benefit of provisional application 60/998,009 filed Oct. 5, 2007, the entire contents of each hereby being incorporated herein by reference.

BACKGROUND OF THE INVENTION

1. Field of the Invention

The present invention relates to a trigger assembly that can serve as a replacement trigger assembly for a Remington 700 rifle trigger assembly and for other rifles.

2. Description of the Related Art

The Remington 700 rifle is a well regarded firearm. The trigger assembly does generally work well for its intended purposes. Yet, there are some aspects of the trigger assembly that can be improved upon.

The Remington 700 rifle trigger assembly has a trigger that is pivotally housed within a housing. The trigger has a finger element and a head. The head has a top and a bottom, with the finger element being integral with the bottom of the head. A pivot hole is formed through the head near the bottom of the head. In this arrangement, pulling the finger element in a first angular direction causes the top of the head to move in the opposite angular direction about the pivot. A sear connect is at the top of the head. When the head rotates a given amount, the sear contact disengages the sear.

One drawback with this arrangement is that the pivot is approximately ½ way between the top of the head and the bottom of the finger element. In this regard, the force applied in the first direction by the user creates a torque on the trigger about the pivot. The created lever arm is less than optimal, as it is approximately equal to ½ of the trigger length. Having a short lever arm can lead to a decrease in the accuracy of the trigger assembly. Reasons for this include the geometry of pulling a short lever, which includes an undesirable ratio in the amount of vertical swing relative horizontal movement.

A further drawback is that the safety engages only the sear. While a safety engaging a single component can be adequate, it would be more desirable to have a safety engage multiple components in the trigger assembly to provide additional security in guarding against unintentional discharges.

There is a need for a trigger assembly that is adjustable between light and heavy.

There is a need for a trigger assembly that has low internal friction.

There is a need for a trigger assembly that is easily adapted for use as a single stage and a double stage trigger assembly.

There is a need for a trigger assembly that utilizes an increased lever arm for increased precision while maintaining a compact overall size.

There is a need for a trigger assembly with additional safety features.

There is a need for a trigger assembly that can act as a set trigger.

Thus there exists a need for a trigger assembly that solves these and other problems.

SUMMARY OF THE INVENTION

The present invention relates to a trigger assembly that can serve as a replacement trigger assembly for a Remington 700 rifle and other rifles. The trigger assembly can have a frame with a first side and a second side. Two spacer blocks can maintain spacing between the sides. A sear can be secured within the frame, and in particular pivotally secured at the front of the sear. A trigger can be provided. The trigger can be pivotally connected to the frame at or near the top of the trigger. A sear transfer bar can be further provided. The sear transfer bar is also pivotally connected to the frame. The pivot in the trigger may be higher within the frame as compared to the pivot of the sear transfer bar. One or more antifriction devices can be between the trigger and the sear transfer bar. The top of the sear transfer bar has a sear contact. Pulling the trigger in a first direction causes the trigger to rotate in a first direction. The trigger can cause the sear transfer bar to rotate after the trigger has rotated a defined amount, wherein pulling the trigger further causes the sear transfer bar to rotate. The sear will drop when the sear contact ceases engagement with the sear, causing the firearm to fire.

According to one advantage of the present invention, the trigger assembly is adjustable between light and heavy. This can be accomplished in several ways. In one embodiment, springs are provided for tensioning the trigger. In another embodiment, magnets are provided for tensioning the trigger. A light trigger can have a trigger pull of approximately 1 pound. A heavy trigger can have a trigger pull in the range of approximately 3 to 5 pounds. The trigger pull of the present invention is adjustable.

According to another advantage of the present invention, the trigger assembly has low internal friction. This is accomplished by selectably placing one or more antifriction devices between the trigger and the sear transfer bar. In one preferred embodiment, the antifriction devices can comprise ball bearings.

According to a further advantage of the present invention, the trigger assembly is easily adapted for use as a single stage and a double stage trigger assembly. This is accomplished in a preferred embodiment by selectably placing one or two antifriction devices between the trigger and the sear contact bar. The geometry of the engagement points between the trigger and the sear transfer bar determine the location and characteristics of the two stages.

According to a still further advantage yet of the present invention, the trigger assembly is utilizes an increased lever arm for increased precision while maintaining a compact overall size. This is accomplished by locating the trigger pivot at or near the top of the trigger such that the effective length of the trigger lever arm is maximized. Increasing the lever arm length can increase the trigger torque and reduce the force required to discharge the firearm. An increased lever arm length decreases the proportional or rational vertical component of the trigger swing.

According to a still further advantage yet of the present invention, the trigger assembly has a sear transfer bar with a radiused sear contact. The radiused sear contact provides a constant distance between the perimeter of the sear contact and the sear as the sear transfer bar rotates about its pivot. The sear, accordingly, will not travel until the sear contact clears and allows the sear to drop.

According to a still further advantage yet of the present invention, the trigger assembly is provided with a safety that acts as a double safety. This is accomplished by having a safety with one lug preventing the sear from dropping and a second lug preventing the sear transfer bar from pivoting out of the way of the sear.

According to a still further advantage yet of one embodiment of the present invention, the trigger can be configured to act as a set trigger. Friction between the sear transfer bar and the sear will hold the sear transfer bar in the set position between the first stage and the second stage. The trigger assembly can be un-cocked by toggling the safety to the safe position.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
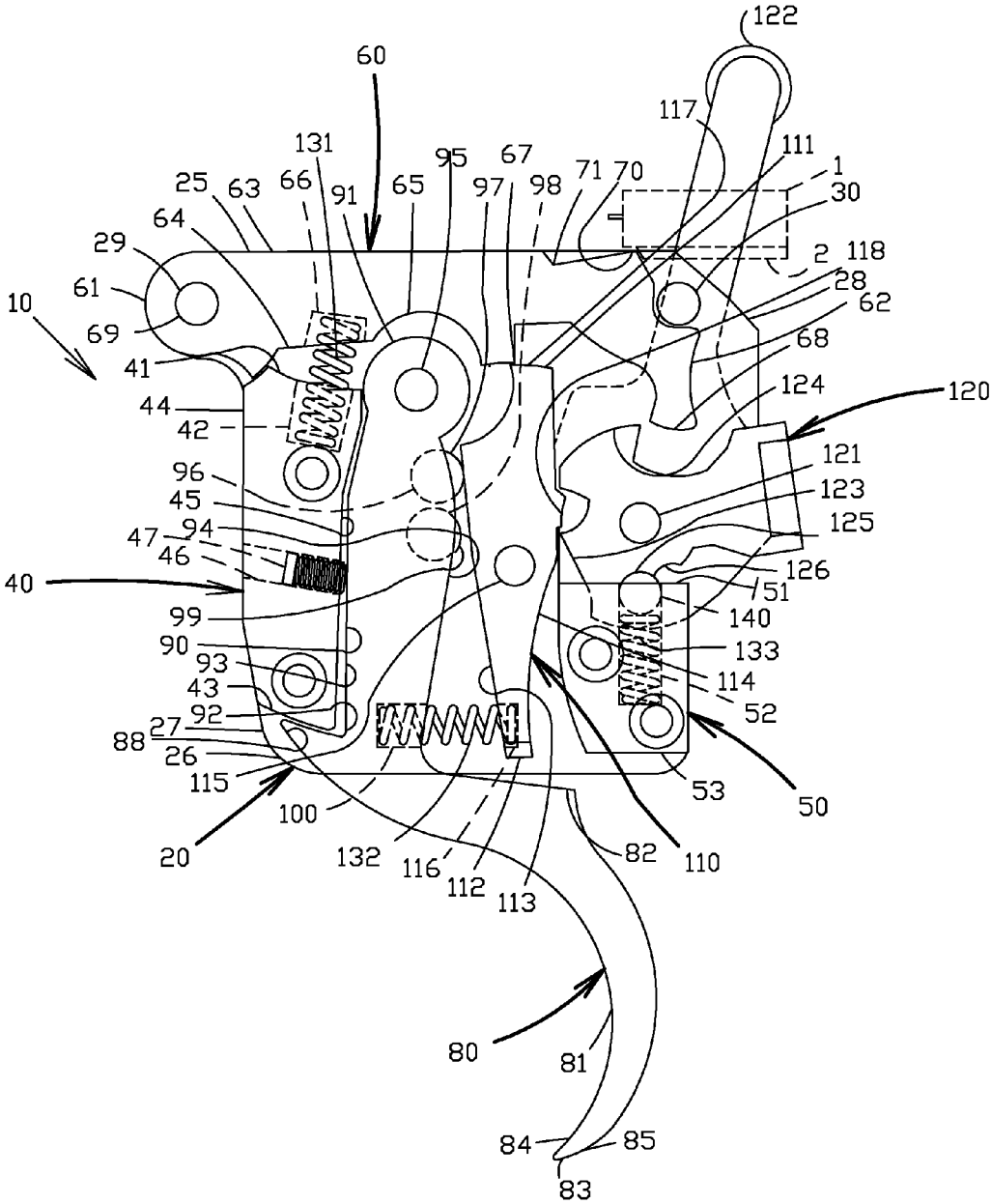
FIG. 1 is a side view of a first preferred embodiment of the present invention shown in a ready position.
Figure 2:
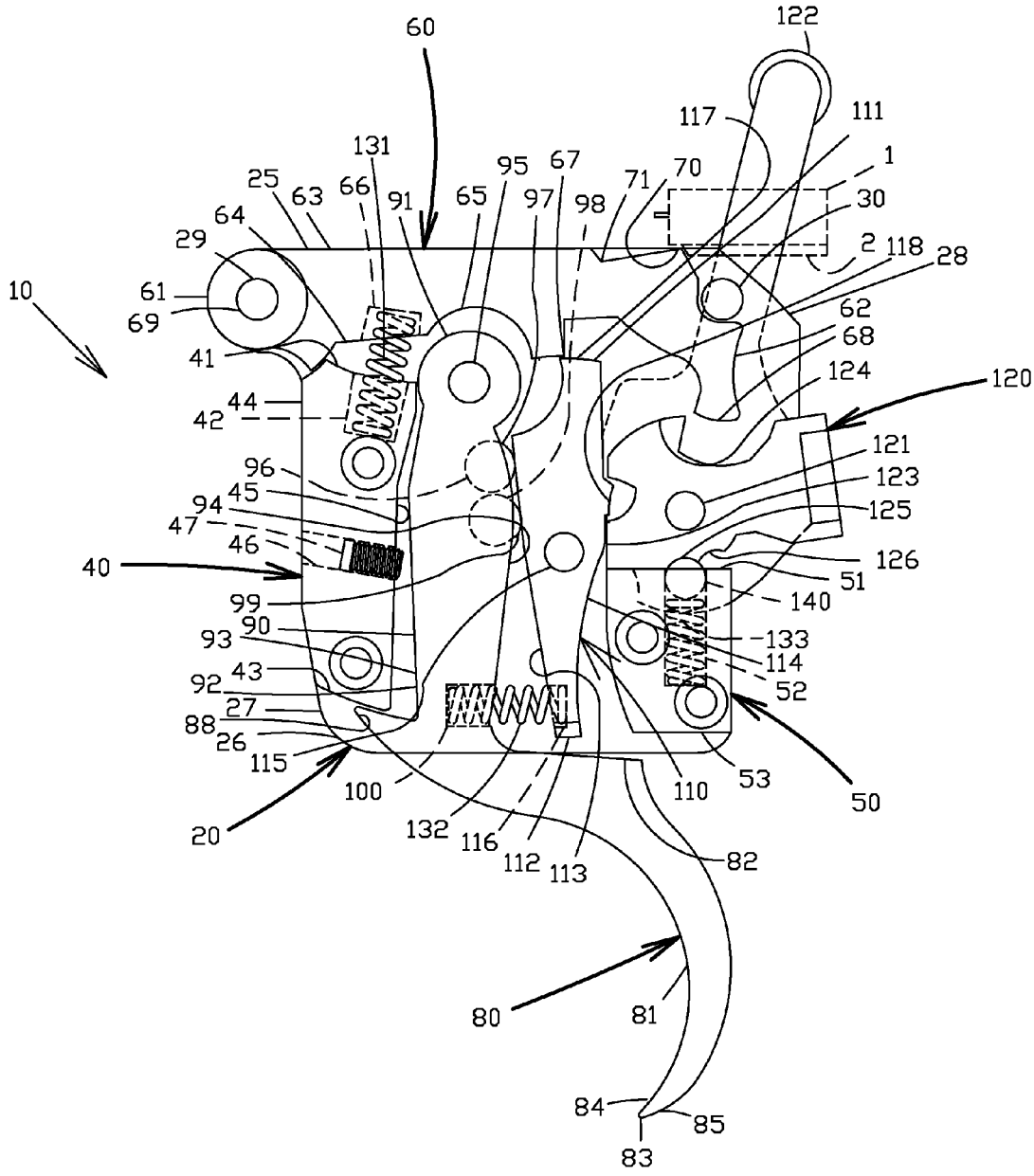
FIG. 2 is a side view of the embodiment shown in FIG. 1 shown in the stage 1 position.
Figure 3:
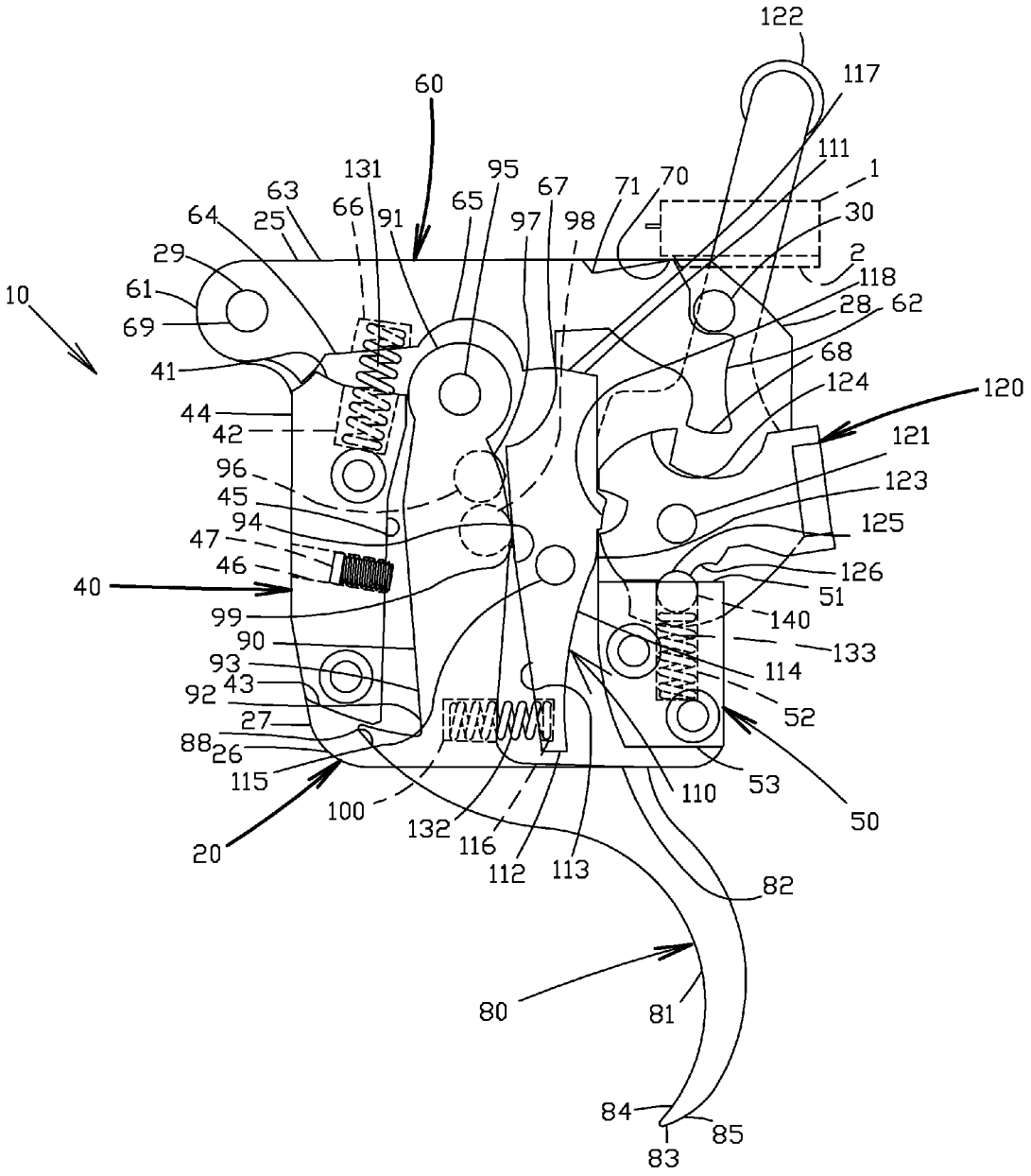
FIG. 3 is a side view of the embodiment shown in FIG. 1 shown in the stage 2 position.
Figure 4:
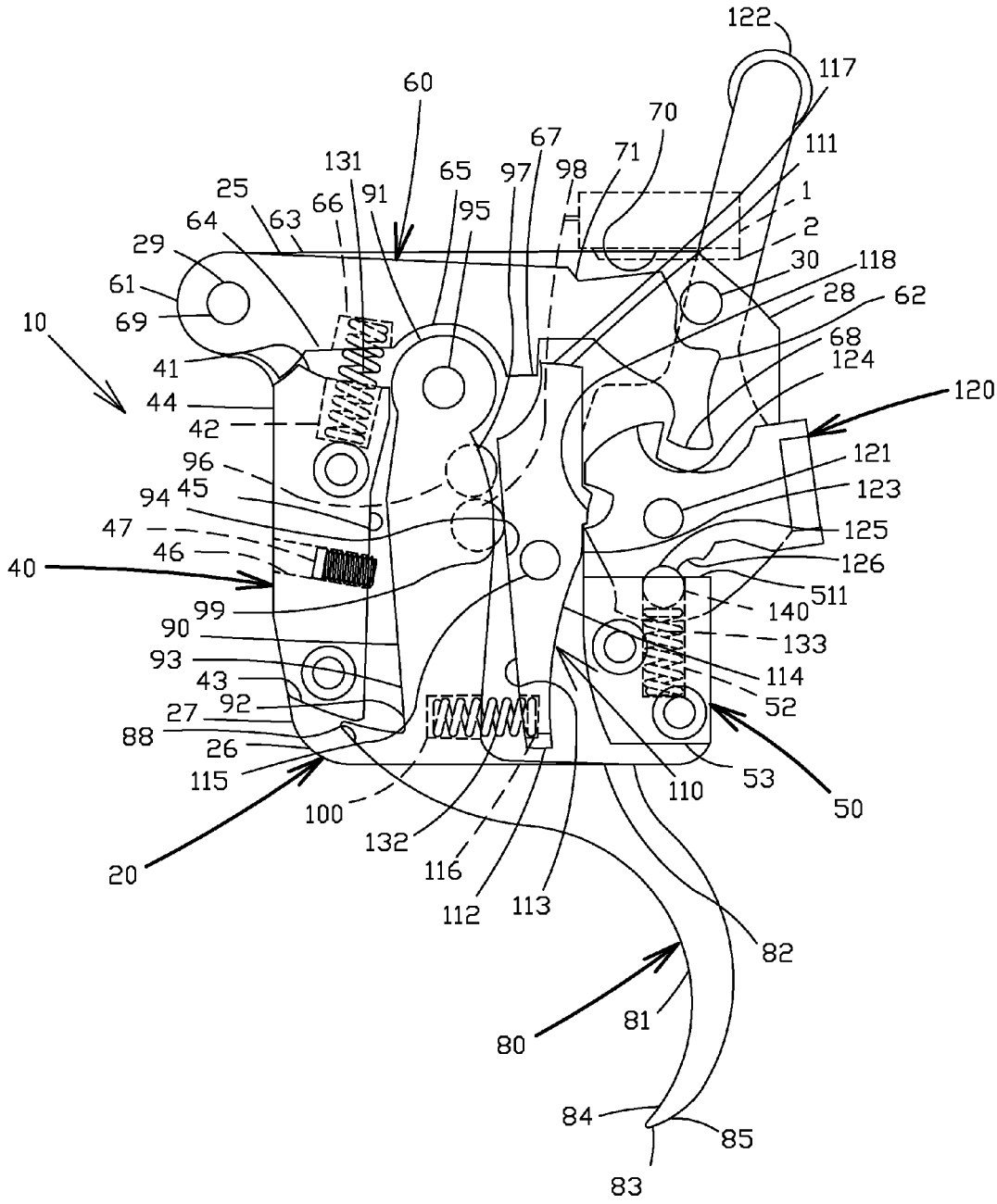
FIG. 4 is a side view of the embodiment shown in FIG. 1 shown in the fired or safety off position.
Figure 5:
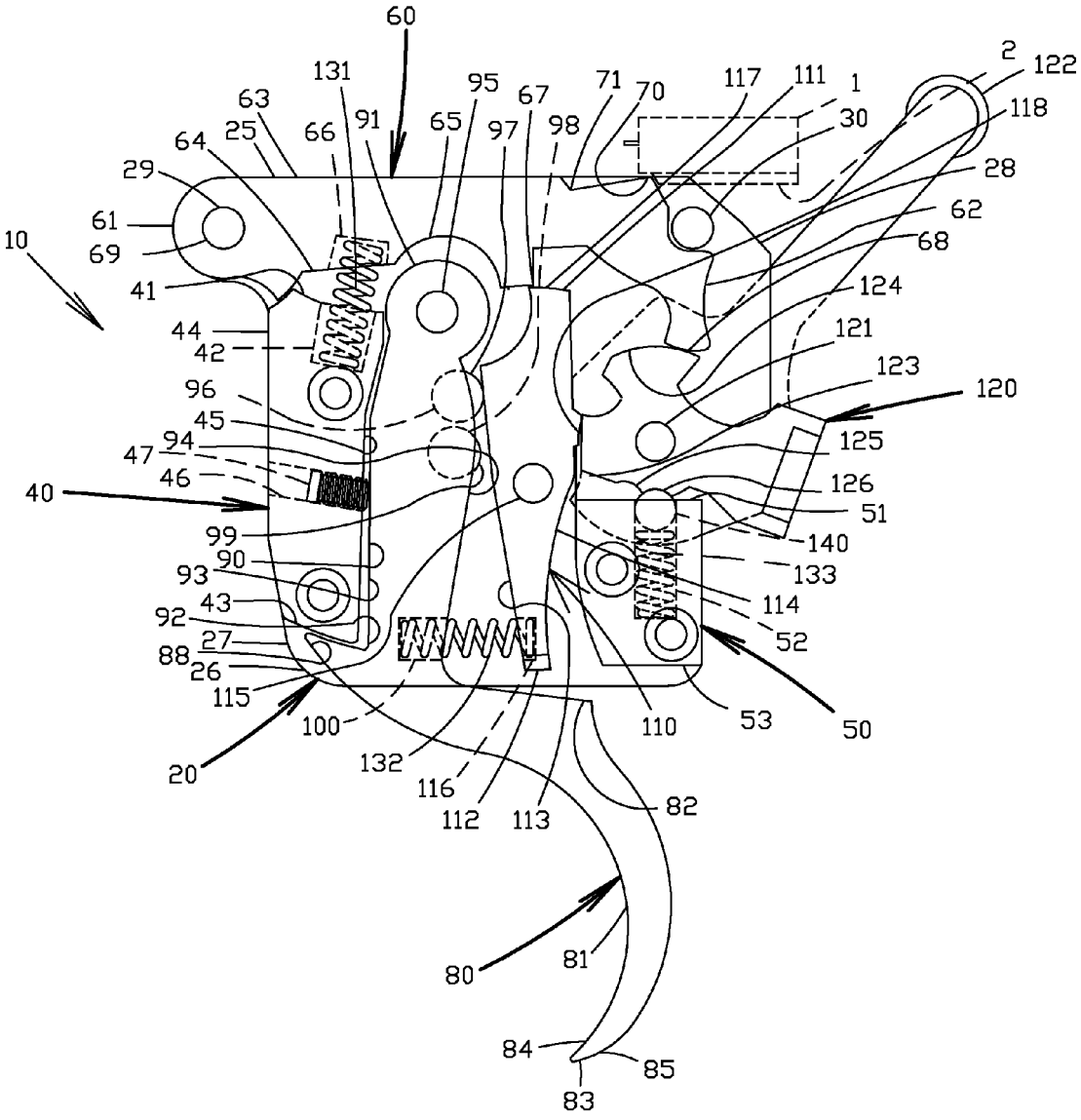
FIG. 5 is a side view of the embodiment shown in FIG. 1 shown in the safety on position.
Figure 6:
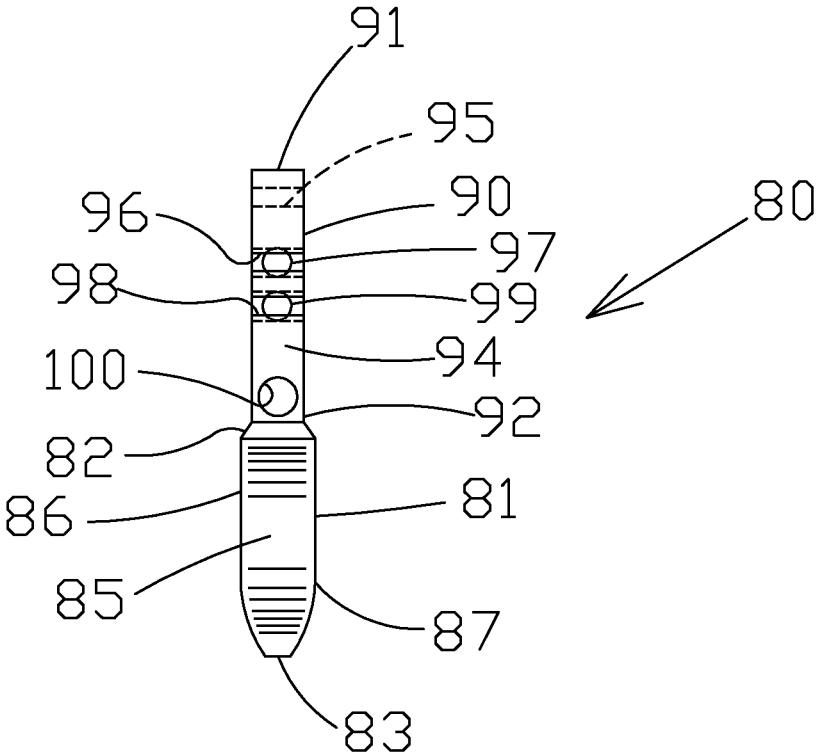
FIG. 6 is an isolated rear view of the trigger.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention can be used with a Remington 700 rifle, and with similar style rifles. In a basic configuration, the firearm has a barrel with a longitudinal axis. The firearm has a cocking piece 1 with a cocking piece contact 2. The cocking piece 1 fires when the cocking piece contact 2 clears the sear (described below).

Turning now to FIGS. 1-5, a first preferred embodiment of a trigger assembly 10 is provided. The trigger assembly 10 can be a direct replacement for a standard assembly. The trigger assembly 10 has a frame 20, a front spacer block 40, a rear spacer block 50, a sear 60, a trigger 80, a sear transfer bar 100 and a safety 120. Each of these components is described in detail below.

The frame 20 has a first side and an opposed second side. Plates can be used on the sides to contain the other components of the housing. In the illustrated embodiment, one plate is removed to more clearly illustrate the components of the trigger assembly 10. The frame 20 comprises a top 25 and a bottom 26, a front 27 and a rear 28. A first hole 29 is through the frame 20. Hole 29 is preferably near the top 25 and front 27 of the frame 20. A second hole 30 is also provided. The second hole 30 is preferably near the top 25 and rear 28 of the frame 20. In one embodiment, the mount hole is round. In an alternative embodiment, the mount hole can comprise a single hole defined by two offset circles forming a double crescent hole. This allows the present assembly to be used with multiple firearms and in particular with firearms having the similar but different frame requirements. Mounting pins (not shown) can be received within holes 29 and 30 to hold and secure the frame 20 in place within the firearm.

The front spacer block 40 is located at the front 25 of the frame between the two sides. The block 40 has a top 41 with a pocket 42 formed therein. The pocket receives the end of a spring 131. One preferred spring is a simple coil spring. It is appreciated that the spring is but one example of a force member that may be utilized within the present invention. The block 40 further has a bottom 43, a front 44 and a rear 45. A hole 46 can be formed through the block 40 and be open to the front 44 and rear 45. The hole 46 is preferably a threaded hole and can receive a set screw 47. The screw 47 can extend from the rear of the spacer block 40 to adjust trigger creep. It is appreciated that an additional hole (not shown) may also provided for receiving an embedded switch, such as a proximity switch for use with an integrated laser rangefinder (LRF) sight system.

Spacer block 50 is at the rear 28 of the frame. The block 50 has a top 51 with a pocket 52 formed therein. The pocket can receive one end of a spring 133. One preferred spring is a simple coil spring. The block 50 further has a bottom 53.

The first spacer block 40 and the second spacer block 50 maintain proper spacing of the side plates of the trigger assembly.

The sear 60 may be similar to a standard sear used in the Remington 700 rifles. The sear 60 is located at the top 25 of the frame 20. The sear 60 has a front 61 and a rear 62, a top 63 and a bottom 64. An area 65 along the bottom 64 of the sear is relieved to make clearance during the fired or safety off position described below. A hole or pocket 66 is formed in the bottom 64 of the sear 60. The second end of spring 131 can be received within hole 66. The spring 131 provides a force against the sear 60 so that the top rear portion of the sear rests against a pin that supports the housing. The sear has a sear contact 67. The sear contact 67 is at the bottom of the sear 60 between the front and the rear of the sear. A safety ear 68 is also provided. The ear 68 is at the bottom and rear of the sear. A pivot 69 is provided. The pivot hole is concentric with mounting hole 29 through the frame, wherein the mounting pin passes through both holes. The sear 60 can be in a first position and a second position. In the first position, the sear 60 can be engaged by the cocking piece. In this regard, the cocking piece contact 2 of the cocking piece 1 can engage a cocking piece contact 70 of the sear 60. The cocking piece contact 2 of the cocking piece 1 can move past the sear 60 when the sear drops to its second position (shown in FIG. 4). A clearance step 71 can be provided to prevent interference between the sear 70 and cocking piece when the firearm is fired.

A trigger 80, as seen in FIGS. 1-6, is further provided. The trigger 80 has a finger element 81 and an arm 90. The finger element 81 and arm 90 are preferably integrally formed as a single component. The finger element 81 has a top 82 and a bottom 83. The finger element 81 further has a front 84 and a rear 85. During use, the user applies a rearward force to the finger element by pulling against the front 84 surface. The finger element 81 further has a first side 86 and a second side 87. A lip 88 projects forward at the top 82 of the finger element 81. The lip 88 acts to prevent dust, dirt and other debris from entering the internal chamber of the trigger assembly 10 by coming into close engagement with the spacer block 40 in the ready position.

The trigger 80 further has an arm 90. Arm 90 has a top 91, a bottom 92, a front 93 and a rear 94. A pivot hole 95 is through the trigger between the sides. The pivot hole 95 is located near or adjacent to the top 91 of the arm 90 of the trigger 80. The lever arm of the trigger 80 is effectively maximized. In this regard, the radius of rotation is approximately equal to the length of the trigger, resulting in minimum vertical variation of the trigger as it horizontally moves to the fired position.

A first channel 96 and a second channel 98 are provided between the sides of the arm, and are open to the rear 94 of the arm 90. In this regard, the channels 96 and 98 generally resemble the shape of a C. A ball 97 is received within channel 96, and a ball 99 is received within channel 98. The balls project a selected distance rearward from the back 94 of the arm 90 of the trigger 80. It is appreciated that having two balls results in a two-stage trigger. It is within the scope of the present invention to eliminate one ball, which would result in a single stage trigger. It is further appreciated that balls are but one example of a balled or rounded surface that could reduce friction between the components.

A pocket 100 is formed at the bottom 92 of the arm and is open to the rear 94. The pocket can receive an end of a spring 132.

A sear transfer bar 110, or simply transfer bar, is further provided. The sear transfer bar 110 has a top 111, a bottom 112, a front 113 and a rear 114. A pivot hole 115 is through the bar 110 at a point approximately half way between the top 111 and bottom 112. It is understood that the location of the pivot of the transfer bar 110 may be moved without departing from the broad aspects of the present invention. A pocket 116 is formed in the transfer bar at the bottom 112 and is open to the front 113. The second end of spring 132 is received within pocket 116. A sear engager 117 is also provided. The sear engager 117 preferably comprises a radiused edge that contacts the sear contact 67 of the sear 60. The sear engager 117 maintains constant location of the sear regardless of the rotational orientation of the bar 110. A safety ear 118 is provided of the bar 110. The safety ear 118 is preferably on the rear 114 of the bar between the top 111 and the bottom 112.

Spring 132 applies a force to the bottom of the transfer bar 110 and bias the back of the transfer bar to against the safety or the second mounting plate. The spring force is overcome by the force of the trigger contacting the transfer bar when the trigger reaches a determined geometric location. Spring 132 remains in compression after the firearm fires and provides a force to force the bottom 112 of the bar 110 away from the released trigger 80 so that the sear contact 67 of the sear 60 and the sear engager 117 of the transfer bar can reengage.

During the step of pulling the trigger, the trigger can move from the first stage through the second to be in the set position. It is seen that the two balls 97 and 99 of the trigger 80 engage the transfer bar 110 in FIG. 2, which shows the end of the first stage. Further pulling of the trigger 80 (FIG. 3) results in only the second ball 99 contacting the transfer bar. At this point, further rotation of the trigger 80 about the pivot 95 will result in the ball 99 applying a greater force to the transfer bar 110 than the spring 132 applies. Since the ball 99 contacts the transfer bar 110 above pivot 115, and the spring 132 acts below the pivot, further movement of the trigger will cause the transfer bar 110 to rotate about pivot 115. It is understood that the trigger and the transfer bar will rotate in opposite directions because the trigger contacts the transfer bar above the center of rotation. It is further understood that the contact between the trigger and contact bar may occur below the transfer bar pivot, which would result in the trigger and transfer bar rotation in offset tandem without departing from the broad aspects of the present invention. The sear engager 115 of the transfer bar 110 will cease engagement with the sear contact 67 of the sear 60 when the transfer bar rotates, causing the sear second end 62 to drop and the firearm to fire.

It is appreciated that other low friction interfaces can be used between the trigger 80 and sear transfer bar 110 without departing from the broad aspects of the present invention. For example, the balls could be located in the transfer bar 110 instead of the trigger 80 without departing from the broad aspects of the present invention.

A safety 120 is still further provided yet. The safety 120 is preferably a double safety, and accordingly engages at least two internal components of the trigger assembly. The safety has a pivot 121. A control arm 122 is provided for toggling the safety 120 between a safe position and a ready position. The control arm 122 can be justified for a left-handed shooter and for a right-handed shooter. A first lug 123 is provided for engaging the safety ear 118 of the transfer bar 110. A second lug 124 is also provided for engaging safety ear 68 of the sear 60. With the safety 120 in the safe position, lug 123 prevents the transfer bar from rotating (hence maintaining engagement between the sear engager 117 of the transfer bar 110 and the sear contact 67 of the sear), and lug 124 directly prevents the sear 60 from dropping. When the firearm is in the set position, the trigger assembly can be uncocked by placing the safety to the safe position. In this regard, lug 123 presses against ear 118 of the bar 110 to rotate bar 110 about pivot 105 away from the set position. Two detents 125 and 126 are provided. A safety ball 140, or simply a ball, is further provided. The ball 140 rests on a spring 133 that is within pocket 52 in the spacer block 50. The ball engages detent 125 when the trigger assembly is not in the safety on position, and engages detent 126 when the trigger assembly is in the safety on position. The control arm 122 is used to effect the toggling between the detents 125 and 126, wherein spring 133 is temporarily compressed to allow the ball to move between the detents.

Figure 7:
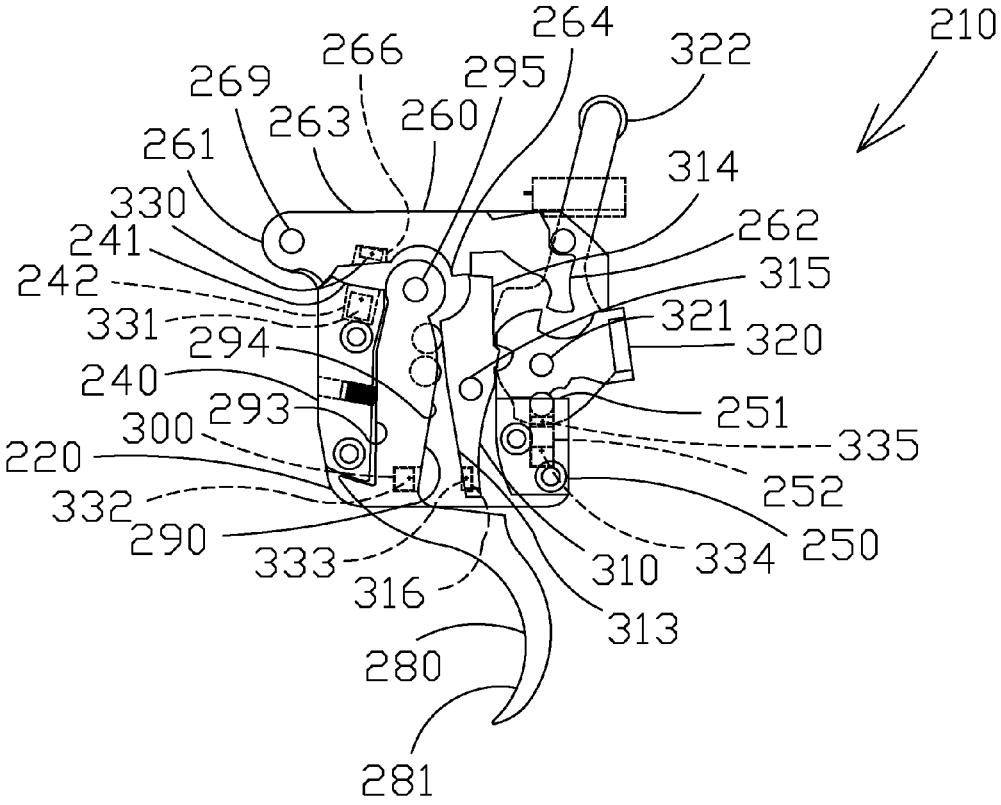
FIG. 7 is a side view of an alternative embodiment of the present invention.
Figure 8:
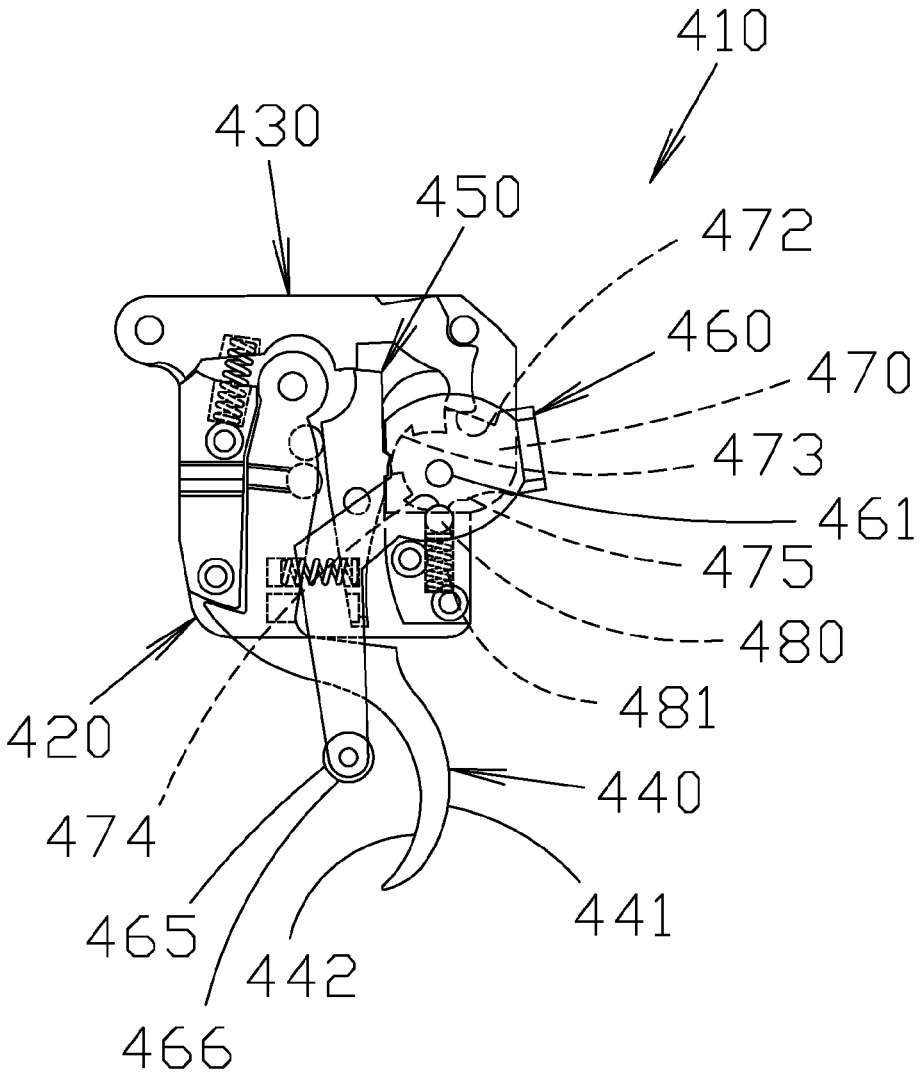
FIG. 8 is a side view of an alternative embodiment of the present invention in a safety on position.
Figure 9:
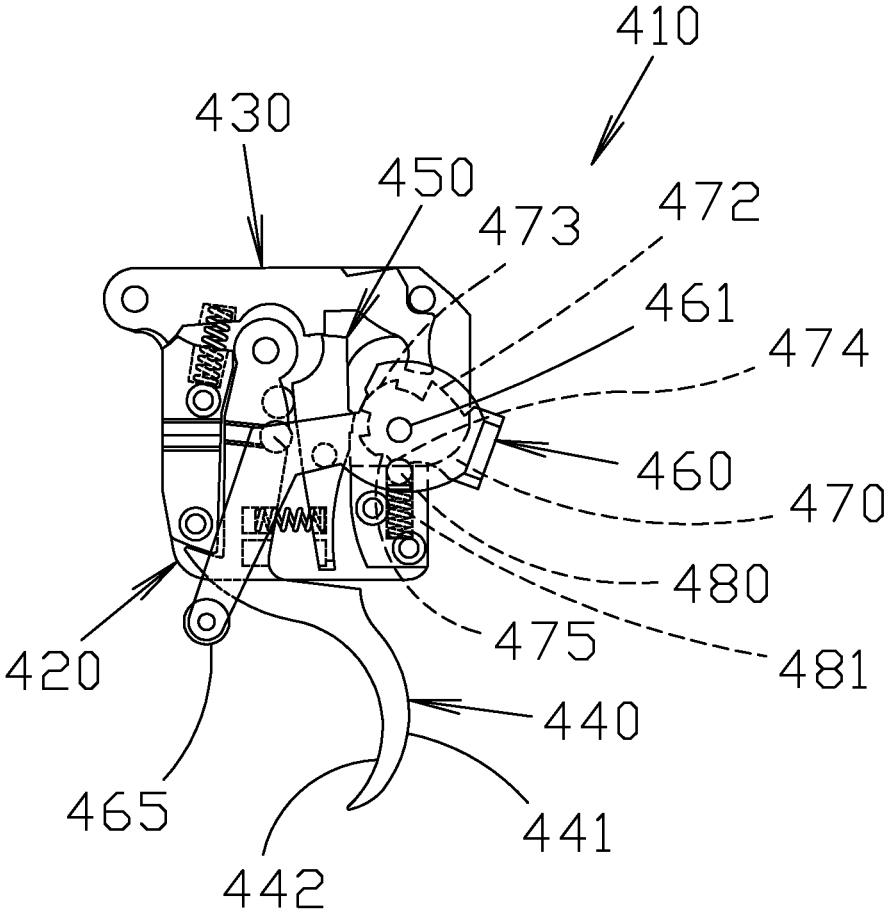
FIG. 9 is similar to FIG. 8, but is illustrated in a safety off position.
Figure 10:
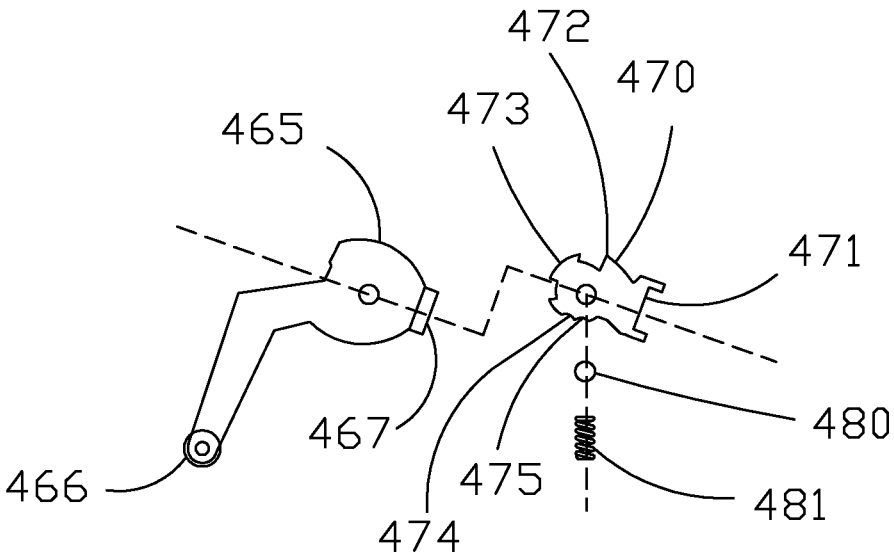
FIG. 10 is an exploded side view of a preferred embodiment of a safety of the present invention.

Turning now to FIG. 7, a second preferred embodiment of a trigger assembly 210 is provided. The trigger assembly 210 can be a direct replacement for a standard assembly. The trigger assembly 210 has a frame 220, a front spacer block 240, a rear spacer block 250, a sear 260, a trigger 280, a sear transfer bar 300 and a safety 320. Each of these components is described in detail below.

The frame 220 has a first side and an opposed second side. Plates can be used on the sides to contain the other components of the housing. In the illustrated embodiment, one plate is removed to more clearly illustrate the components of the trigger assembly 210. The frame 220 comprises a top and a bottom, a front and a rear. A first hole is through the frame 220. Hole is preferably near the top and front of the frame 220. A second hole is also provided. The second hole is preferably near the top and rear of the frame 220. In one embodiment, the mount hole is round. In an alternative embodiment, the mount hole can comprise a single hole defined by two offset circles forming a double crescent hole. This allows the present assembly to be used with multiple firearms and in particular with firearms having the similar but different frame requirements. Mounting pins (not shown) can be received within holes and to hold and secure the frame 220 in place within the firearm.

The front spacer block 240 is located at the front of the frame between the two sides. The block 240 has a top 241 with a pocket 242 formed therein. The block 240 further has a bottom, a front and a rear. A hole can be formed through the block 240 and be open to the front and rear. The hole is preferably a threaded hole and can receive a set screw. The screw can extend from the rear of the spacer block 240 to adjust trigger creep. It is appreciated that an additional hole (not shown) may also provided for receiving an embedded switch, such as a proximity switch for use with an integrated laser rangefinder (LRF) sight system.

Spacer block 250 is at the rear of the frame. The block 250 has a top 251 with a pocket 252 formed therein. The block 250 further has a bottom.

The first spacer block 240 and the second spacer block 250 maintain proper spacing of the side plates of the trigger assembly 210.

The sear 260 may be similar to a standard sear used in the Remington 700 rifles. The sear 260 is located at the top of the frame 220. The sear 260 has a front 261 and a rear 262, a top 263 and a bottom 264. An area along the bottom 264 of the sear is relieved to make clearance during the fired position. A hole or pocket 266 is formed in the bottom 264 of the sear 260. The sear has a sear contact. The sear contact is at the bottom of the sear 260 between the front and the rear of the sear. A safety ear is also provided. The ear is at the bottom and rear of the sear. A pivot 269 is provided. The pivot hole is concentric with mounting hole through the frame, wherein the mounting pin passes through both holes. The sear 260 can be in a first position and a second position. In the first position, the sear 260 can be engaged by the cocking piece. In this regard, the cocking piece contact of the cocking piece can engage a cocking piece contact of the sear 260. The cocking piece contact of the cocking piece can move past the sear 260 when the sear drops to its second position. A clearance step can be provided to prevent interference between the sear 270 and cocking piece when the firearm is fired.

A trigger 280 is further provided. The trigger 280 has a finger element 281 and an arm 290. The finger element 281 and arm 290 are preferably integrally formed as a single component. The finger element 281 has a top and a bottom. The finger element 281 further has a front and a rear. During use, the user applies a rearward force to the finger element by pulling against the front surface. The finger element 281 further has a first side and a second side. A lip projects forward at the top of the finger element 281. The lip acts to prevent dust, dirt and other debris from entering the internal chamber of the trigger assembly 210 by coming into close engagement with the spacer block 240 in the ready position.

The trigger 280 further has an arm 290. Arm 90 has a top, a bottom, a front 293 and a rear 294. A pivot hole 295 is through the trigger between the sides. The pivot hole 295 is located near the top of the arm 290 of the trigger 280. The lever arm of the trigger 280 is effectively maximized. In this regard, the radius of rotation is approximately equal to the length of the trigger, resulting in minimum vertical variation of the trigger as it horizontally moves to the fired position.

A first channel and a second channel are provided between the sides of the arm, and are open to the rear of the arm 290. In this regard, the channels generally resemble the shape of a C. A ball is received within channel, and a ball is received within channel. The balls project a selected distance rearward from the back of the arm 290 of the trigger 280. It is appreciated that having two balls results in a two-stage trigger. It is within the scope of the present invention to eliminate one ball, which would result in a single stage trigger. A pocket 300 is formed at the bottom of the arm and is open to the rear.

A sear transfer bar 310 is further provided. The sear transfer bar 310 has a top, a bottom, a front 313 and a rear 314. A pivot hole 315 is through the bar 310 at a point approximately half way between the top and bottom. A pocket 316 is formed in the transfer bar at the bottom and is open to the front. A sear engager is also provided. The sear engager preferably comprises a radiused edge that contacts the sear contact of the sear 260. The sear engager maintains constant location of the sear regardless of the rotational orientation of the bar 310. A safety ear is provided of the bar 310. The safety ear is preferably on the rear of the bar between the top and the bottom.

During the step of pulling the trigger, the trigger can move from the first stage through the second to be in the set position. The two balls of the trigger 280 may engage the transfer bar 310, which occurs at the end of the first stage. Further pulling of the trigger 280 results in only the second ball contacting the transfer bar. At this point, further rotation of the trigger 280 about the pivot 295 will result in the ball applying a greater force to the transfer bar 310 than the forcing component (described below) applies. Since the ball contacts the transfer bar 310 above pivot 315, and the forcing component acts below the pivot, further movement of the trigger will cause the transfer bar 310 to rotate about pivot 315. The sear engager of the transfer bar 310 will cease engagement with the sear contact of the sear 260 when the transfer bar rotates, causing the sear second end to drop and the firearm to fire.

It is appreciated that other low friction interfaces can be used between the trigger 280 and sear transfer bar 310 without departing from the broad aspects of the present invention. For example, the balls could be located in the transfer bar 310 instead of the trigger 280 without departing from the broad aspects of the present invention.

A safety 320 is still further provided yet. The safety 320 is preferably a double safety, having a pivot 321. A control arm 322 is provided for toggling the safety 320 between a safe position and a ready position. The control arm 322 can be justified for a left-handed shooter and for a right-handed shooter. A first lug is provided for engaging the safety ear of the transfer bar 310. A second lug is also provided for engaging safety ear of the sear 260. With the safety 320 in the safe position, lug prevents the transfer bar from rotating (hence maintaining engagement between the sear engager of the transfer bar and the sear contact of the sear), and the second lug directly prevents the sear 260 from dropping. When the firearm is in the set position, the trigger assembly can be uncocked by placing the safety to the safe position. In this regard, the first lug presses against ear of the bar 310 to rotate bar 310 about pivot away from the set position. Two detents and are provided. A ball is further provided. The ball engages detent when the trigger assembly is not in the safety on position, and engages detent when the trigger assembly is in the safety on position. The control arm 322 is used to effect the toggling between the detents, wherein the force component is temporarily compressed to allow the ball to move between the detents.

In this preferred embodiment, the force components may be comprised of pairs of magnets that are oriented in repulsion. In this regard, a series of magnets are preferably provided for maintaining the arrangement of the components and returning the trigger to the ready position. The magnets can be made of NeFeB, or any other suitable magnetic material.

One magnet 330 is received within the pocket 266 of the sear 260, and a second magnet 331 is received within the pocket of the first spacer block 240. Magnets 330 and 331 are oriented in repulsion so that there exists a repulsive force between the sear and the first spacer block.

A magnet 332 is received within the pocket 300 of the trigger 280, and a second magnet 333 is received within the pocket 316 of the transfer bar 310. Magnets 332 and 333 are oriented in repulsion so that there exists a repulsive force between the trigger and the bottom of the transfer bar.

Two magnets 335 and 336 are received within the pocket 52 of spacer block. The magnets are in repulsion, wherein a ball is biased upwards to engage one of the detents of the safety to maintain the safety in the desired position.

It is appreciated that because of the orientation (linear) of the polarity (opposites attract and equals repulse) of the magnets, the magnets will perform similar in function to springs. Accordingly, the trigger pull weight can be adjusted by adjusting the magnets.

It is appreciated that the location and strength of the magnets may be selected in order to adjust the firing characteristics of the firearm.

Turning now to FIGS. 8-11, it is seen that a third preferred embodiment of a trigger assembly 410 is provided. The trigger assembly 410 can be a direct replacement for a standard assembly. The trigger assembly 410 has a frame 420, a sear 430, a trigger 440 and a sear transfer bar 450. Each of these components is similar to and has similar subcomponents as the like-named parts above. Specifically, the trigger 440 has a finger element 441 with a front 442 and a back. The user engages the front 442 of the finger element 441 while pulling the trigger 440.

The trigger assembly 410 further has a safety 460. Safety 460 is preferably a double safety, and accordingly engages at least two internal components (the sear 430 and the sear transfer bar 450) of the trigger assembly.

Figure 11:
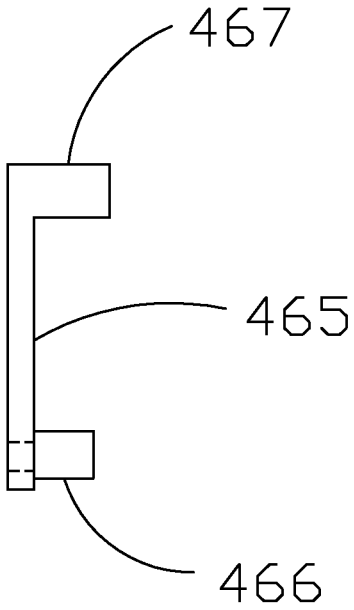
FIG. 11 is an end view showing a preferred key of a control arm.

The safety 460 has a pivot 461. The pivot 461 can comprise a pin or shaft, about which the safety 460 rotates. A control arm 465 is provided for toggling the safety 460 between a safe position and a ready position. The control arm 465 has an end with an end knob 466. The end knob 466 can be screwed onto the end of the control arm 465 and be selectably positionable in front of the front 442 of the finger element 441 of the trigger 440. The knob 466 can be affixed to the control arm 465 after the control arm is fed through the frame 420. The control arm 465 can be justified for a left-handed shooter and for a right-handed shooter. An end key 467 is provided for accomplishing this, as described below. The key 467 preferably is formed from a generally right angle bend in the stock material, wherein the key 467 is generally perpendicular to the remainder of the arm 465 as best seen in FIG. 11.

The safety further has a rotating body 470. The body has a slot 471 there through for receiving the key 467. The key 467 can engage the slot 471 from either direction depending upon whether the safety 460 is developed for left or right orientation.

A first lug 472 is provided on the body 470 for engaging the safety ear of the transfer bar 450. A second lug 473 is also provided for engaging safety ear of the sear 430. With the safety 460 in the safe position, lug 472 prevents the transfer bar from rotating (hence maintaining engagement between the sear engager of the transfer bar 450 and the sear contact of the sear 430), and lug 473 directly prevents the sear 430 from dropping. When the firearm is in the set position, the trigger assembly can be uncocked by placing the safety to the safe position. In this regard, lug 472 presses against ear of the bar 450 to rotate bar 450 about pivot away from the set position.

Two detents 474 and 475 are provided. A safety ball 480, or simply a ball, is further provided. The ball 480 rests on a spring 481 that is within pocket in the spacer block. The ball engages detent 475 when the trigger assembly is not in the safety on position, and engages detent 474 when the trigger assembly is in the safety on position. The control arm 465 is used to effect the toggling between the detents 474 and 475, wherein spring 481 is temporarily compressed to allow the ball to move between the detents. The control arm 465 can have a first position adjacent to and in front of the front 442 of the finger element 441. In this regard, the control arm 465 of the safety interferes with operation of the trigger in addition to ball 480 engaging the first detent 474. The control arm has a second position rotated away from the front of the finger element of the trigger wherein it does not interfere with the engagement of the trigger in addition to the ball 480 engaging the second detent 475.

It is appreciated that the control arm 465 can be positioned selectably for left and right handed configurations.

Thus it is apparent that there has been provided, in accordance with the invention, a trigger assembly that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A trigger assembly comprising:

a frame;

a trigger pivotally connected to said frame;

a transfer bar pivotally connected to said frame;

a sear pivotally connected to said frame, and a safety, said safety selectably engaging both said transfer bar and said sear when in a safety on position, wherein:

said transfer bar engages said sear to prevent said sear from dropping in a ready position, and said transfer bar ceases engagement with said sear to allow said sear to drop under operation of said trigger.

2. The trigger assembly of claim 1 wherein:

said safety further comprises a control arm, a first detent and a second detent; and said trigger assembly comprises a safety ball for maintaining said safety in the selected position by being positioned in one of said first detent and said second detent under operation of said control arm.

3. The trigger assembly of claim 1 wherein:

said trigger has a trigger top and a trigger bottom, said trigger being pivotally connected to said frame adjacent said trigger top; and said transfer bar has a transfer bar top and a transfer bar bottom, said transfer bar being pivotally connected to said frame between said transfer bar top and said transfer bar bottom, wherein said trigger contacts said transfer bar at at least one location between the point of pivotal connection between said transfer bar and said frame, and said transfer bar top, whereby said trigger causes said transfer bar to rotate opposite of the direction of the rotation of said trigger.

4. A trigger assembly comprising:

a frame;

a trigger pivotally connected to said frame;

a transfer bar pivotally connected to said frame;

a sear pivotally connected to said frame, and a safety, said safety selectably engaging both said transfer bar and said sear when in a safety on position, said safety comprising a control arm extending beyond said frame.

5. The trigger assembly of claim 4 wherein:

said frame has a frame top and a frame bottom;

said trigger extends from said frame bottom; and said control arm extends above said frame top.

* * * * *